US008341892B2

(12) United States Patent
Tugnoli

(10) Patent No.: US 8,341,892 B2
(45) Date of Patent: Jan. 1, 2013

(54) STRUCTURE FOR AWNINGS, ARBOURS AND THE LIKE

(75) Inventor: Michele Tugnoli, Bologna (IT)

(73) Assignee: Corradi S.p.A., Bologna (IT)

( * ) Notice: Subject to any disclaimer, the term of this patent is extended or adjusted under 35 U.S.C. 154(b) by 305 days.

(21) Appl. No.: 12/926,060

(22) Filed: Oct. 25, 2010

(65) Prior Publication Data

US 2012/0096776 A1 Apr. 26, 2012

(51) Int. Cl.
*E04D 13/00* (2006.01)
*E04D 13/08* (2006.01)

(52) U.S. Cl. ..... 52/12; 52/14; 52/97; 52/69; 160/44

(58) Field of Classification Search ..... 52/11–17, 52/64–72, 97; 160/22, 66, 44, 23.1, 67, 26, 160/33, 38; 135/88.11, 88.12
See application file for complete search history.

(56) References Cited

U.S. PATENT DOCUMENTS 3,360,886 A * 1/1968 Deddo ..... 49/71
4,452,230 A * 6/1984 Nelson ..... 126/621
4,696,131 A * 9/1987 Schreffler ..... 52/11
5,437,138 A * 8/1995 Tuohey et al. ..... 52/741.1
5,575,118 A * 11/1996 Vahldieck ..... 52/11
5,586,837 A * 12/1996 Udelle ..... 52/12
5,678,360 A * 10/1997 Fort et al. ..... 52/14
6,182,399 B1 * 2/2001 Pollera ..... 52/11
7,871,017 B2 * 1/2011 Van Zutven ..... 239/289

* cited by examiner

*Primary Examiner* — Jeanette E. Chapman
(74) *Attorney, Agent, or Firm* — Modiano & Associati; Albert Josif; Daniel J. O'Byrne

(57) ABSTRACT

A structure for awnings and arbours, comprising a supporting frame, provided with respective front columns, which are designed to support guide beams for a covering canopy and for at least one movable crosspiece, which is in turn associated with an end flap of the covering canopy.
At least one collection duct for rainwater being provided with at least one sealing element, in order to prevent the penetration of water, and is also provided with at least one outlet for draining the water, which extends externally from the duct and is substantially faced towards at least one respective hole, which is defined in at least one respective tubular body, which is substantially vertical and is associated with a corresponding front column. The outlet is substantially accommodated within the hole when the crosspiece is in the configuration of maximum advancement towards the front columns and the covering canopy is completely extended.

9 Claims, 2 Drawing Sheets

STRUCTURE FOR AWNINGS, ARBOURS AND THE LIKE

The present invention relates to a structure for awnings, arbours and the like.

BACKGROUND OF THE INVENTION

In recent years in the outdoor furnishing sector, rapid advances have been seen in awnings, arbours and similar structures, which, from simple coverings capable of providing shelter from the sun in warm weather, have been transformed into structures capable of offering protection under any weather conditions.

Nowadays the outdoor structures available on the market are in fact increasingly capable of protecting the occupants, as well as from the sun, also from the wind, rain and snow (while at the same time ensuring the capacity to support the load associated with the structure).

Precisely in order to allow the collection of rainwater, elements for the conveyance of water, such as guttering or ducting of various different types, are often associated with such structures.

Alongside the new functionalities mentioned above, in recent years increasing attention has been turned, by consumers, to the aesthetic appearance of the awnings and arbours themselves, which has forced companies in the sector to look for solutions with a design that is pleasing and attractive.

Such constructive solutions are, however, not without drawbacks.

The presence of additional external elements, such as, indeed, guttering or other types of ducting, required for the conveyance of rainwater, determines a deterioration in the overall appearance of the structure, thus making it impossible to fully satisfy the need, which as noted is very felt, of ensuring an attractive design.

SUMMARY OF THE INVENTION

The aim of the present invention is to solve the above-mentioned drawbacks, by devising a structure that ensures the collection of rainwater, while at the same time ensuring the possibility to make awnings, arbours and the like which have an attractive and pleasing appearance.

Within this aim, an object of the invention is to provide a structure that is capable of effectively conveying the substantial totality of the rainwater, so preventing dripping, even partial, along the other elements of the structure.

Another object of the invention is to provide a structure that has high stability and mechanical resistance, even in the presence of major stresses owing to the weather conditions.

A further object of the invention is to provide a structure that ensures a high level of reliability in operation.

A further object of the invention is to provide a structure that can be easily made from elements and materials that are easily sourced on the market.

A further object of the invention is to provide a structure that can be made at low cost and safely applied.

This aim and these and other objects which will become better apparent hereinafter are achieved by a structure for awnings, arbours and the like, which comprises a supporting frame, provided with respective front columns, to support guide beams for a covering canopy and for at least one movable crosspiece, which is associated with an end flap of said covering canopy, characterised in that it comprises at least one collection duct for rainwater, which is open above and which is jointly connected to said crosspiece, said duct being provided with at least one sealing element, in order to prevent the penetration of water, and with at least one outlet for draining the water, which extends externally from said duct and is substantially faced towards at least one respective hole, which is defined in at least one respective tubular body, which is substantially vertical and is associated with a corresponding front column, said at least one outlet being substantially accommodated within said at least one hole when said crosspiece is in the configuration of maximum advancement towards said front columns and the covering canopy is completely extended, for the conveyance and draining to the ground of the rainwater arriving at said duct from said covering canopy.

BRIEF DESCRIPTION OF THE DRAWINGS

Further characteristics and advantages of the invention will become better apparent from the following detailed description of a preferred, but not exclusive, embodiment of the structure according to the invention, illustrated by way of non-limiting example in the accompanying drawings, wherein.

DESCRIPTION OF THE PREFERRED EMBODIMENTS

Figure 1:
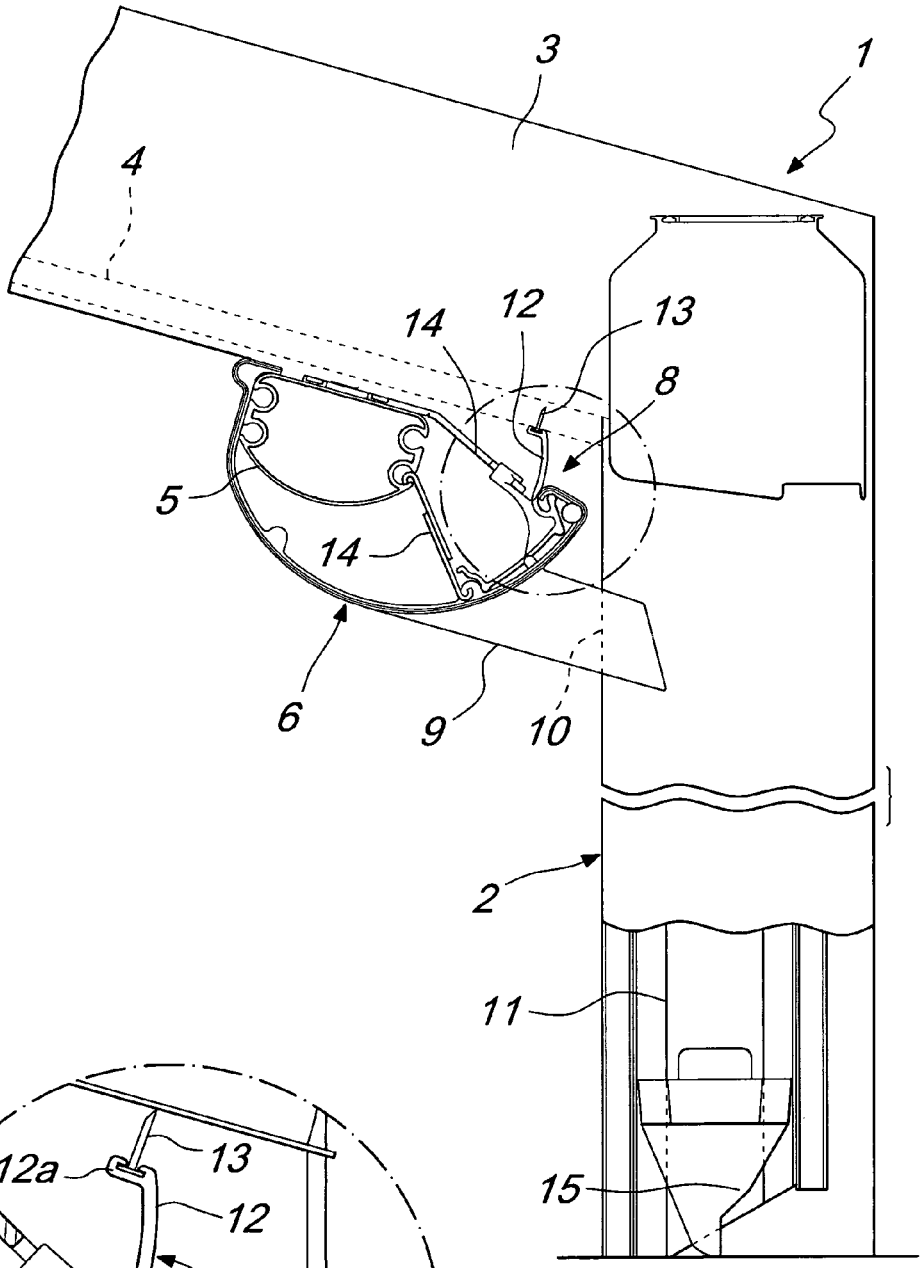
FIG. 1 is a cross-sectional view of a portion of the structure according to the invention.
Figure 2:
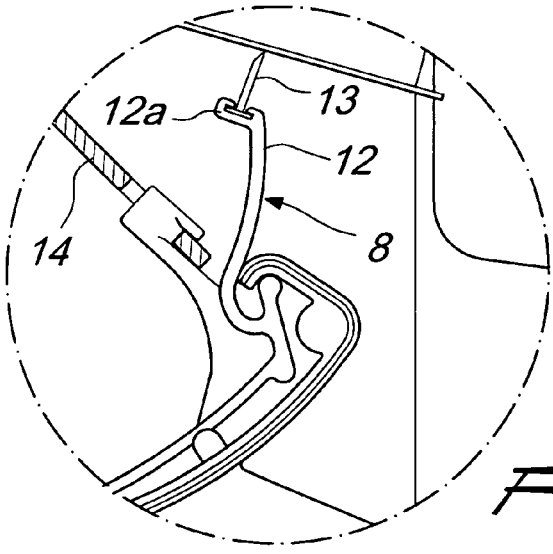
FIG. 2 is a greatly enlarged view of a detail of FIG. 1.

With reference to the figures, the structure for awnings, arbours and the like, according to the invention, is generally designated by the reference numeral 1. It should be clear that the use of the structure 1 for awnings and arbours constitutes a preferred application of the present invention, and constant reference shall be made to it hereinafter, but the use of the structure 1 in different sectors, according to specific requirements, is not excluded and still falls within the scope of protection claimed herein.

The structure 1 comprises a supporting frame, provided with respective front columns 2, to support guide beams 3 for a covering canopy 4 and for at least one movable crosspiece 5, which is associated with an end flap of the covering canopy 4.

According to the invention, the structure 1 comprises a collection duct 6 for rainwater, which is open above (in order to collect the water that flows on the upper face of the canopy 4) and which is jointly connected to the crosspiece 5 which is associated with the end flap of the canopy 4.

In more detail, according to a non-limiting embodiment of the application of the invention, known on the market by the name "retractable awning", the covering canopy 4 (preferably made of a flexible textile or polymeric material) is associated with a plurality of movable crosspieces 5 which are parallel to each other, each of which is coupled to slides 7 which slide along the beams 3.

The sliding of the slides 7 thus produces the complete extension of the canopy 4 (or, vice versa, its retraction), in order to completely cover the area which is under the frame and is delimited by the front columns 2 (or, vice versa, in order to expose it to atmospheric agents).

According to this embodiment, it is therefore the end crosspiece 5, which is associated with the end flap of the canopy 4, which is jointly connected to the collection duct 6.

In its turn, the collection duct 6 is provided with at least one sealing element 8, in order to prevent the penetration of water, and is also provided with at least one outlet 9 for draining the water, which, as shown in the accompanying figures, extends externally from the duct 6 and is substantially faced towards at least one respective hole 10, which is defined in at least one respective tubular body 11, which is substantially vertical and is associated with a corresponding front column 2.

The drainage outlet 9 thus moves jointly with the duct 6 and with the movable crosspiece 5, until it is accommodated in the hole 10 (as shown in FIG. 1) when the crosspiece 5 is in the configuration of maximum advancement towards the front columns 2 and the covering canopy 4 is completely extended, in order to produce the conveyance and draining to the ground (through the tubular body 11) of the rainwater which arrives at the duct 6 from the covering canopy 4.

So if rainwater falls on the upper surface of the canopy 4, and then flows down it, such water is collected in the duct 6 (which is suitably arranged at the end flap of the canopy 4) and from the duct 6 the water is conveyed, via the outlet 9, into the tubular body 11 which directs it towards the ground.

More specifically, according to a possible embodiment, the structure 1 comprises a plurality of drainage outlets 9, which are distributed along the collection duct 6 and are facing towards respective holes 10 provided in corresponding tubular bodies 11 (which are associated with respective columns 2) of the supporting frame. Each outlet 9 is brought to be accommodated in a respective hole 10 when the crosspiece 5 is in the configuration of maximum advancement towards the front columns 2 and the covering canopy 4 is completely extended.

Advantageously, the sealing element 8 comprises a raised lip 12, which extends substantially vertically from the edge of the upper opening 6*a* of the duct 6 opposite to the canopy 4, in order to favour the collection of the substantial totality of the rainwater coming from the covering canopy 4. The presence of the lip 12 defines in fact an obstacle which prevents the mass of water that flows along the upper face of the canopy 4 from passing over the opening 6*a* and therefore from falling beyond the duct 6, and instead favours its conveyance into the opening 6*a* and thus towards the duct 6 and the tubular body 11.

Moreover, the lip 12 can positively have, at its top, a seat 12*a* which is capable of accommodating a gasket 13 which extends upwards, until it is brought substantially into contact with at least one of the beams 3, in order to thus collect any drips of rainwater that flow along the beams 3 and which, otherwise, could flow along these beams 3 without being collected by the duct 6.

According to a possible, non-limiting embodiment of the application of the invention which is substantially modular in type, the collection duct 6 comprises at least two concave side members which are connected by at least one connector which can be stably coupled to a respective end of each of such side members, which are preferably provided with a respective drainage outlet 9.

In particular, the side members can be a plurality, so as to allow the construction of ducts 6 of any length which are adapted to any type of frame.

In this case the connectors will be subdivided into closure connectors, closed on one side with an end wall and adapted to close off the end of the side member with which they are associated, and middle connectors, adapted to couple respective facing and proximate ends of two adjacent side members.

With further reference to the embodiment described above, which provides for the use of at least two side members, the structure 1 according to the invention usefully comprises sealing means (possibly of known type), which can be interposed between the connector and each end of the side members, in order to prevent the penetration of rainwater at the regions of discontinuity of the collection duct 6 (such regions of discontinuity being constituted by the very junction points of the connectors with the ends of the side members).

Figure 3:
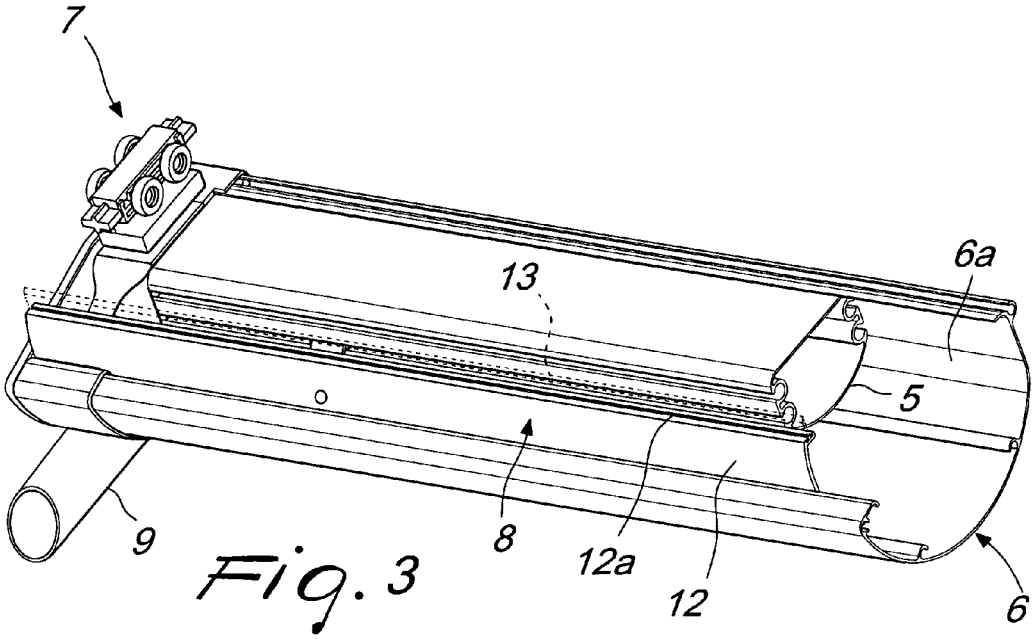
FIG. 3 is a perspective view of the movable crosspiece and the collection duct.
Figure 4:
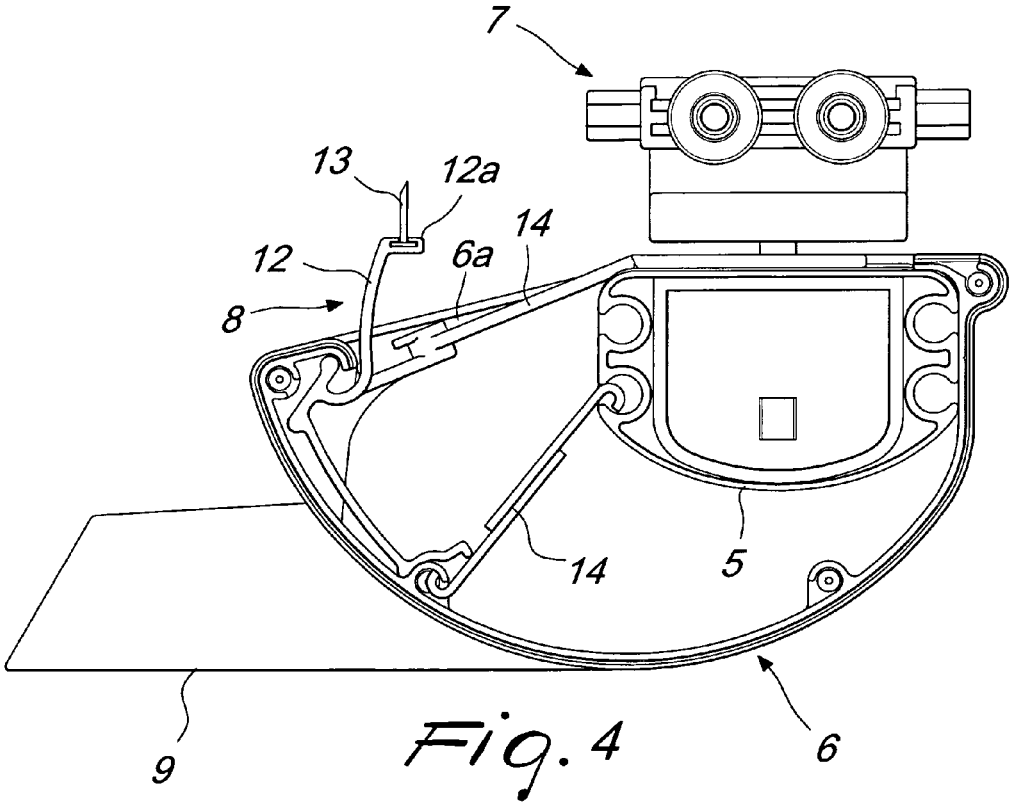
FIG. 4 is a sectional view of FIG. 3, taken along a transversal plane that crosses an end portion of the crosspiece and of the duct.

Advantageously, as can be seen in particular from FIGS. 1, 3 and 4, according to the preferred (but not exclusive) embodiment, the end crosspiece 5, which is arranged substantially according to an axis which is parallel to the axis of the collection duct 6, is substantially accommodated within the duct 6. Moreover, the area of the transverse cross-section of the crosspiece 5 is chosen to be preferably less than one third of the area of the transverse cross-section of the collection duct 6, in order to determine a gap, which is designed to be travelled by the rainwater, that is of sufficiently large size to contain and dispose of even large volumes of water, without danger of overflowing and/or leaking.

Advisably, the structure 1 comprises stiffening brackets 14, which, as shown in particular in FIG. 1, are jointly connected by opposite ends to the crosspiece 5 and to the collection duct 6, in order to give the structure a high mechanical resistance, especially in the event of high stresses owing to adverse weather conditions.

According to the preferred embodiment, the tubular body 11 is preferably accommodated within the respective front column 2 and internally it defines a conveyance channel for the rainwater, which in this way substantially arrives at a drainage trough 15, which is arranged at the base of the column 2 and preferably is facing towards either the ground or a drain.

The operation of the structure according to the invention is as follows.

When the user wishes to use the covering canopy 4, in order to shelter the area underneath from the sun, rain or other weather conditions, he or she can completely extend the canopy 4, by making the slides 7 and the movable crosspieces 5 slide along the beams 3.

Upon the complete extension of the covering canopy 4, the outlets 9 are brought within the holes 10 made in the tubular bodies 11, becoming completely accommodated therein. In this configuration, the rainwater which should fall on the canopy 4 so as then to flow down it, is conveyed into the opening 6*a* of the collection duct 6 (within which the crosspiece 5 which is associated with the end flap of the canopy 4 is contained), and from there it is sent into the tubular body 11 until it exits, at the base of the column 2, via the drainage trough 15.

The presence of the end lip 12 is, as shown, a guarantee that the entire volume of water is directed into the collection duct 6, because, since it rises vertically from the opening 6*a*, it is capable of intercepting the water which might possibly, as a result of its speed and of the slope of the structure 1, pass over the opening 6*a* without falling into it.

Moreover, the gasket 13 is capable of collecting any drips which might flow along the lower surface of the beams 3, so contributing further to conveying the entire volume of water into the duct 6 and so into the tubular body 11.

It therefore appears evident that the structure 1 according to the invention achieves the intended aim, since it is capable of ensuring the collection of rainwater, and more specifically the entire totality of the volume of water that falls on the canopy 4, while at the same time ensuring a design that is pleasing and attractive, since the components of the structure 1 which are designed to convey the rainwater are not visible, since they are accommodated in other components of the structure 1.

With reference to the necessity to provide a structure 1 that is attractive and at the same time functional, it should be noted that the presence of the sealing means is a further guarantee against the risk of any undesired penetrations and leaks, which otherwise could arise at the regions of discontinuity for example after mechanical stresses or heat expansions (as a result of the different expansion coefficients of the materials with which the side members and the connectors can be made, and which are typically sheet metal for the former, and a polymeric material for the latter).

The use of stiffening brackets 14 moreover gives the structure 1 high stability and mechanical resistance, even in the presence of major stresses owing to the weather conditions.

In practice it has been found that the structure according to the invention fully achieves the intended aim, since the use of a collection duct which is provided with a sealing element and with a water drainage outlet, which is accommodated in a hole which is defined in a tubular body which is associated with the front columns of the structure itself, when the crosspiece is in the configuration of maximum advancement towards the front columns and the covering canopy is completely extended, enables to provide a structure which ensures the collection of rainwater, while at the same time ensuring the possibility of making awnings, arbours, and the like, with a pleasing and attractive appearance.

The invention thus conceived is susceptible of numerous modifications and variations, all of which are within the scope of the appended claims. Moreover, all the details can be substituted by other, technically equivalent elements.

For example, it is possible to vary (while still remaining within the scope of protection claimed herein) the dimensions and/or the shape of the drainage outlet 9 as desired, and also of the collection duct 6 and the movable crosspiece 5 accommodated within it, particularly in order to vary the transverse cross-sections affected by the passage of water, so as to thus modify the permitted flow of water.

In the embodiments illustrated, individual characteristics shown in relation to specific examples may in reality be interchanged with other, different characteristics, existing in other embodiments.

Moreover, it should be noted that anything found to be already known during the patenting process is understood not to be claimed and to be the subject of a disclaimer.

In practice the materials employed, as well as the dimensions, may be any according to requirements and to the state of the art.

What is claimed is:

1. A structure for awnings, arbours and the like, which comprises a supporting frame, provided with respective front columns, to support guide beams for a covering canopy and for at least one movable crosspiece, which is associated with an end flap of said covering canopy, comprising at least one collection duct for rainwater, which is open above and which is jointly connected to said crosspiece, said duct being provided with at least one sealing element, in order to prevent the penetration of water, and with at least one outlet for draining the water, which extends externally from said duct and is substantially faced towards at least one respective hole, which is defined in at least one respective tubular body, which is substantially vertical and is associated with a corresponding front column, said at least one outlet being substantially accommodated within said at least one hole when said crosspiece is in the configuration of maximum advancement towards the said front columns and the covering canopy is completely extended, for the conveyance and draining to the ground of the rainwater arriving at said duct from said covering canopy.

2. The structure according to claim 1, comprising a plurality of said drainage outlets, which are distributed along said collection duct and are faced towards respective holes provided in corresponding tubular bodies of said supporting frame, each of said outlets being accommodated in said respective hole when said crosspiece is in the configuration of maximum advancement towards said front columns and the covering canopy is completely extended.

3. The structure according to claim 1, wherein said at least one sealing element comprises at least one raised lip, which extends substantially vertically from the edge of the upper opening of said duct opposite to said canopy, in order to favour the collection of the substantial totality of the rainwater coming from said covering canopy.

4. The structure according to claim 1, wherein said lip has, substantially at its top, a seat for accommodating a gasket which extends upwards to be brought substantially into contact with at least one of said beams, for the collection of any drips of rainwater flowing along said beams.

5. The structure according to claim 1, wherein said collection duct comprises at least two concave side members which are connected by at least one connector which can be stably coupled to a respective end of each of said side members, which are provided with a respective drainage outlet.

6. The structure according to claim 5, comprising sealing means, which are interposed between said connector and each of said ends of said side members, in order to prevent the penetration of rainwater at the regions of discontinuity of said collection duct.

7. The structure according to claim 1, wherein said crosspiece, which is arranged substantially according to an axis which is parallel to the axis of said collection duct, is substantially accommodated within said duct and the area of the transverse cross-section of said crosspiece is less than one third of the area of the transverse cross-section of said collection duct.

8. The structure according to claim 1, comprising stiffening brackets, which are jointly connected by opposite ends to said beam and to said collection duct, in order to give said structure a high mechanical resistance.

9. The structure according to claim 1, wherein said tubular body is accommodated within the respective front column and internally defines a conveyance channel for the rainwater, which substantially arrives at a drainage trough, which is arranged at the base of said column and is faced towards either the ground or a drain.

* * * * *